United States Patent [19]

Inacker et al.

[11] 4,382,237

[45] May 3, 1983

[54] TEMPERATURE COMPENSATION OF A FLUX DRIVE GYROMAGNETIC SYSTEM

[75] Inventors: Henry F. Inacker, Cinnaminson, N.J.; Elmer L. Henderson, Philadelphia, Pa.

[73] Assignee: RCA Corporation, New York, N.Y.

[21] Appl. No.: 272,396

[22] Filed: Jun. 10, 1981

[51] Int. Cl.[3] ..... H01P 1/195

[52] U.S. Cl. ..... 333/24.1; 307/101; 307/310; 307/412

[58] Field of Search ..... 333/1.1, 24.1, 24.2, 333/24.3; 328/3, 11; 307/101, 310, 412

[56] References Cited

U.S. PATENT DOCUMENTS

| | | | |
|---|---|---|---|
| 2,919,434 | 12/1959 | Mestre | 307/412 X |
| 3,316,506 | 4/1967 | Whicker et al. . | |
| 3,445,790 | 5/1969 | Schneider . | |
| 3,735,291 | 5/1973 | Smith . | |
| 3,754,274 | 8/1973 | Auger . | |
| 3,835,397 | 9/1974 | D'Antonio . | |
| 3,946,340 | 3/1976 | Simon . | |
| 3,988,686 | 10/1976 | Beall et al. | 333/24.1 X |
| 4,031,489 | 6/1977 | Bernard et al. . | |

OTHER PUBLICATIONS

Clark et al., *Rapid-Switching Broadband 1:4 WG Switch Matrix, Part II*, Microwave Journal, vol. 16, No. 9, Sep. 1973, pp. 47, 48, 50 and 52.

*Primary Examiner*—Paul L. Gensler

*Attorney, Agent, or Firm*—Joseph S. Tripoli; Robert Ochis

[57] ABSTRACT

A flux drive gyromagnetic system such as a gyromagnetic waveguide phase shifter is temperature compensated by measuring the flux change in the gyromagnetic material during a reverse in saturation magnetization, comparing that change to the change under reference conditions and modifying the drive used to set the gyromagnetic material to a non-saturated condition in accordance with the results of the comparison.

6 Claims, 8 Drawing Figures

Figure 1:
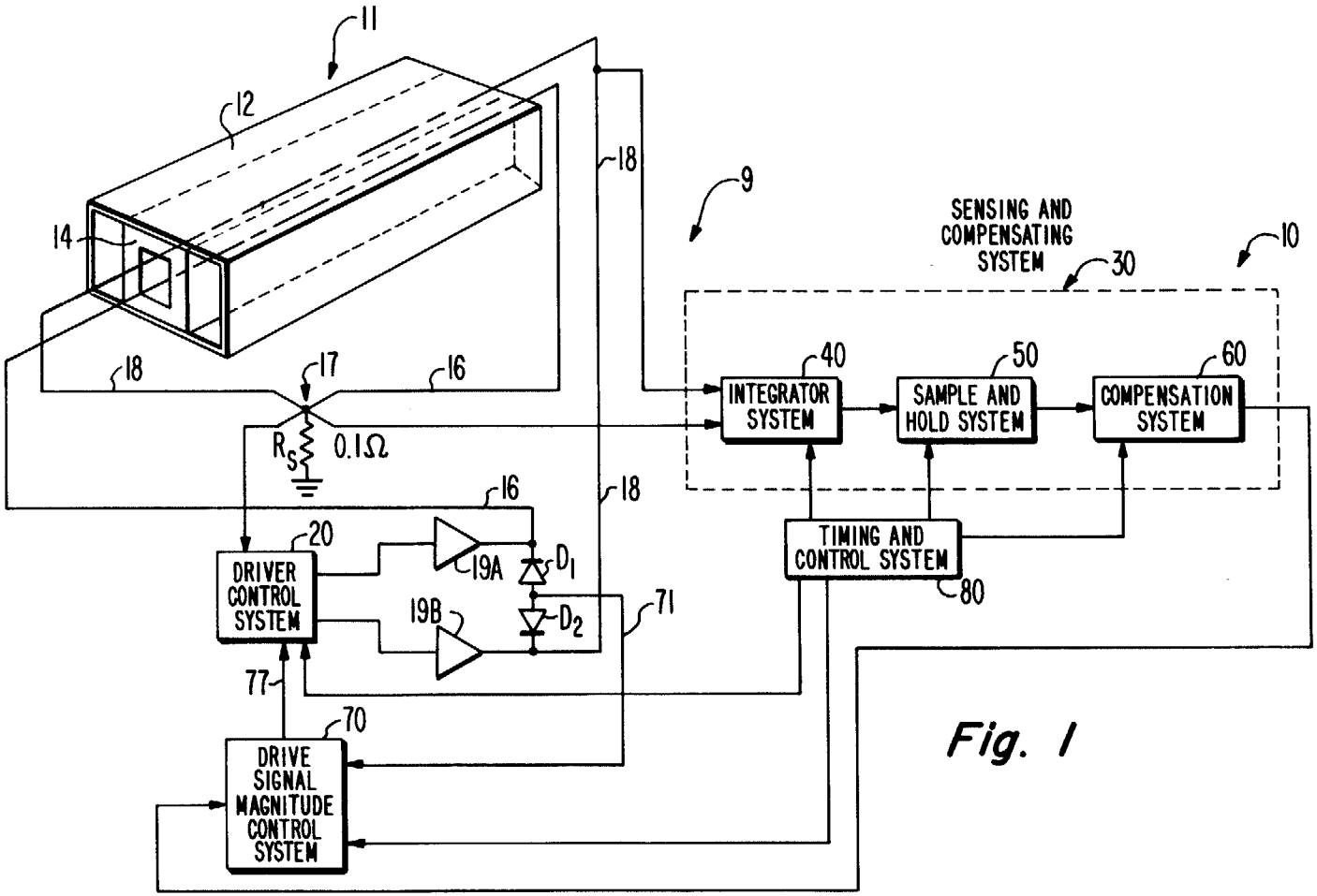

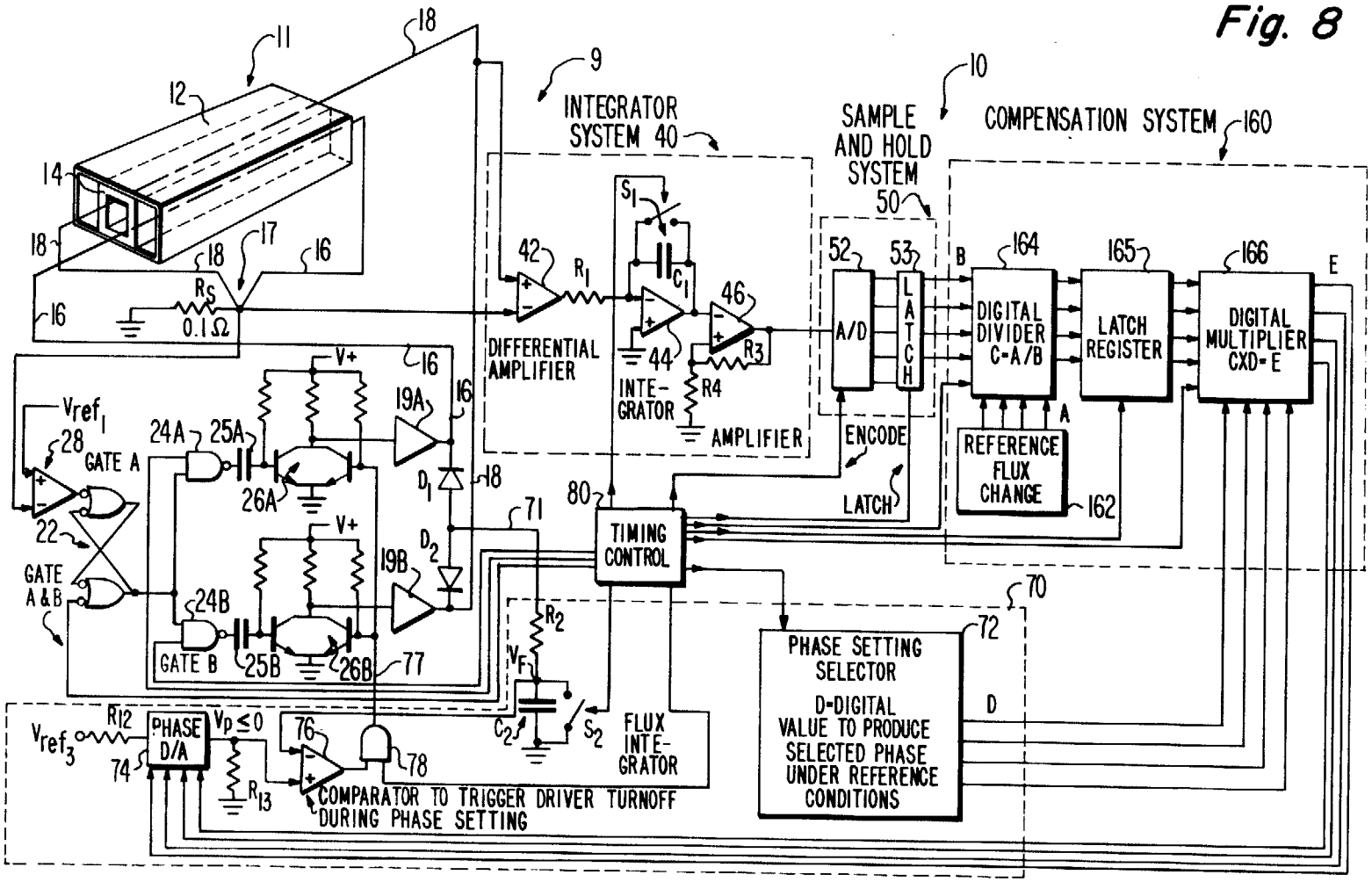
Fig. 8
COMPENSATION SYSTEM
160
DIGITAL MULTIPLIER C×D=E
166
LATCH REGISTER
165
DIGITAL DIVIDER C÷A/B
164
REFERENCE FLUX CHANGE
162
SAMPLE AND HOLD SYSTEM
50
A/D
52
LATCH
53
ENCODE
LATCH
INTEGRATOR SYSTEM 40
DIFFERENTIAL AMPLIFIER
INTE-GRATOR
AMPLIFIER
TIMING CONTROL
PHASE SETTING SELECTOR
D=DIGITAL VALUE TO PRODUCE SELECTED PHASE UNDER REFERENCE CONDITIONS
FLUX INTE-GRATOR
COMPARATOR TO TRIGGER DRIVER TURNOFF DURING PHASE SETTING
PHASE D/A
GATE A
GATE B
GATE A&B
0.1Ω

TEMPERATURE COMPENSATION OF A FLUX DRIVE GYROMAGNETIC SYSTEM

This invention relates to the field of temperature compensation of gyromagnetic systems and, more particularly, to the field of temperature compensation of flux drive gyromagnetic systems.

Gyromagnetic material is a general term intended to include ferrimagnetic materials, ferromagnetic materials and other materials which exhibit magnetic hysteresis. In particular, it specifically includes garnets and ferrites of the types normally used in magnetic waveguide phase shifters.

The B versus H (material magnetization vs. external magnetic field) characteristics of a gyromagnetic material are temperature dependent and as the temperature increases, the B vs. H loop normally contracts thereby reducing the magnitude of the maximum remanence which may be established in the material. Remanence is the residual magnetization of the material after the removal of the external field. Where the gyromagnetic material serves as the phase control material in a flux drive waveguide phase shifter, the phase setting established in response to a given drive signal changes with temperature as a result of temperature induced changes in the B vs. H curve.

Existing gyromagnetic systems either have loose enough tolerance that they are unaffected by temperature induced variations or use thermistors to passively adjust the drive signals with temperature to compensate for these variations. Thermistor temperature compensation systems are considered undesirable in high quality, high reliability systems because thermistors are of variable accuracy and such systems suffer from inaccuracies in extrapolating the temperature of the gyromagnetic material from the conditions sensed by the thermistor no matter where or how carefully the thermistor is positioned. The use of thermistors also increases the parts count in the system and thermistors also have their own reliability problems and failure rates.

A more reliable, mcre efficient method of compensating for temperature variations in the gyromagnetic material is needed for use in high reliability systems which require accurate setting of the remanence of the gyromagnetic material. Such systems include array antennas which have many elements and are designed to produce a narrow beam having very low sidelobes.

In a preferred embodiment of the present invention, a sensing and compensation system is included in a flux drive gyromagnetic system to sense the net flux change induced in the gyromagnetic material during a reversal of its saturated remanence. The net flux change is a function of the condition (primarily the temperature) of the gyromagnetic material. System drive signals are adjusted to compensate for differences between the actual material characteristics as sensed and nominal material characteristics on which system control is based.

Figure 2:
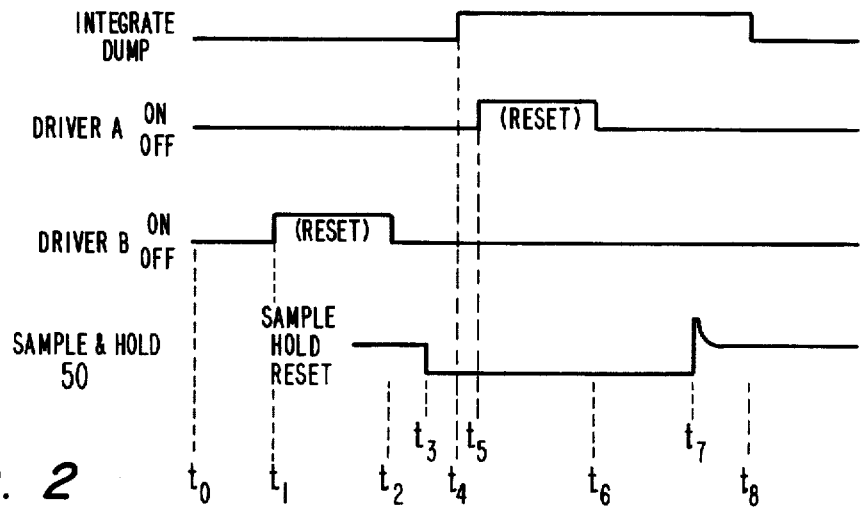
Figure 4:
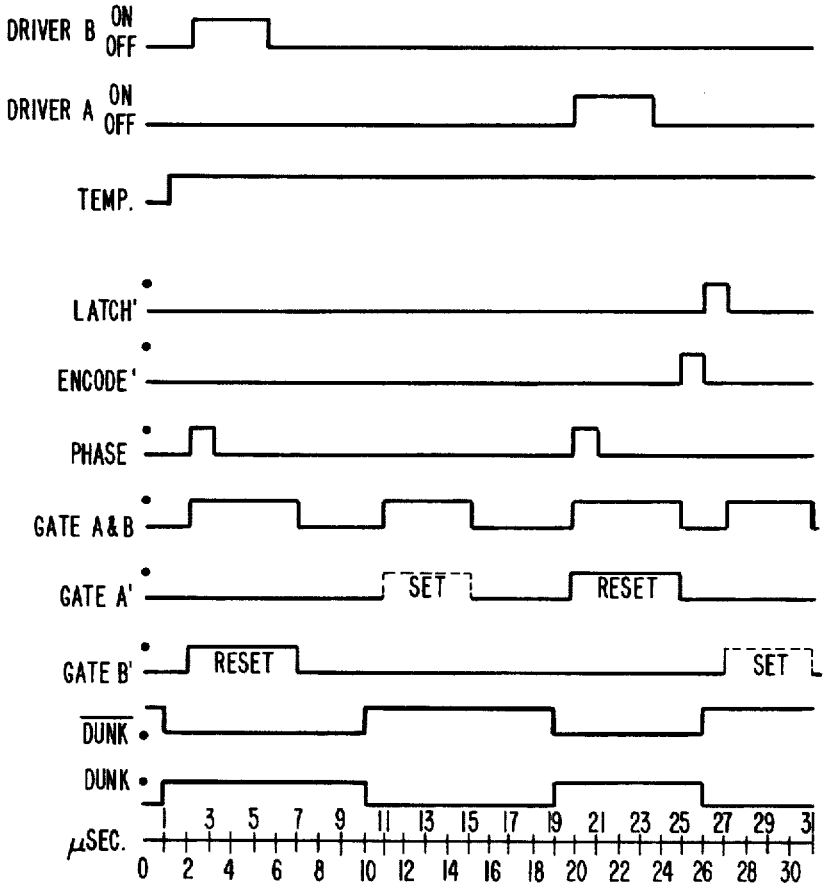
Figure 3:
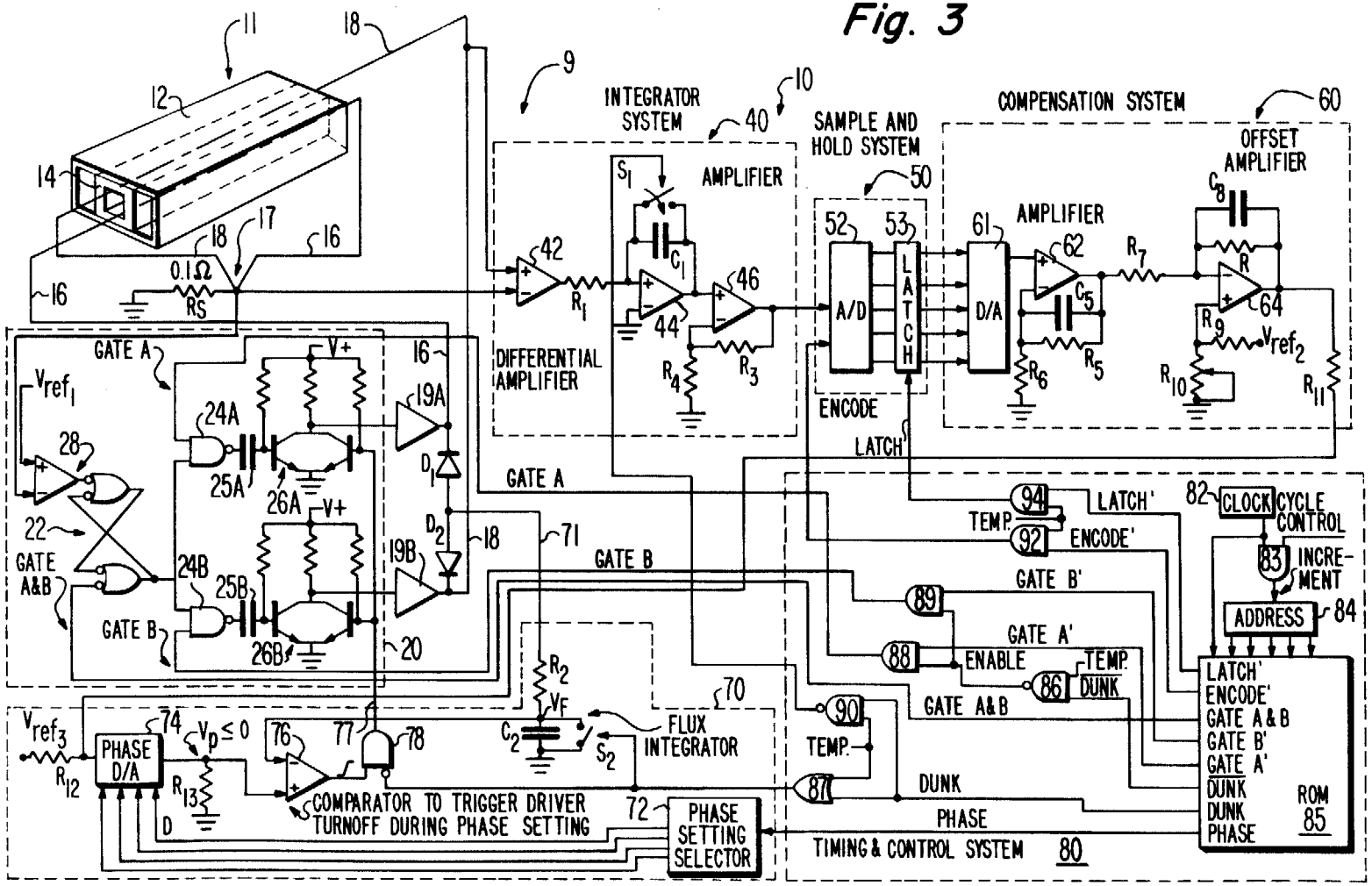
Figure 5:
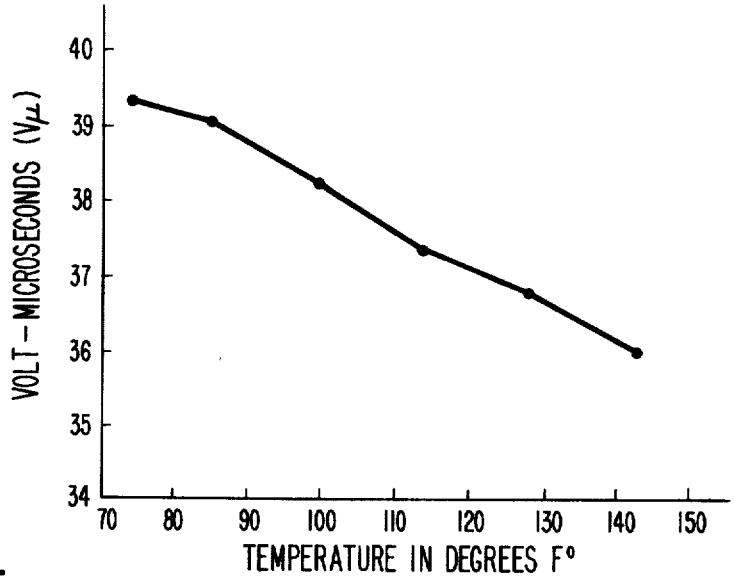
Figure 6:
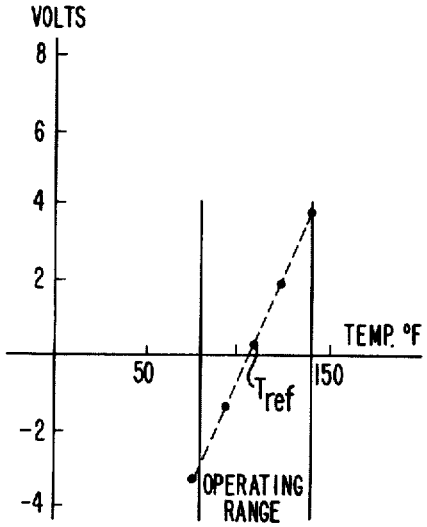
Figure 7:
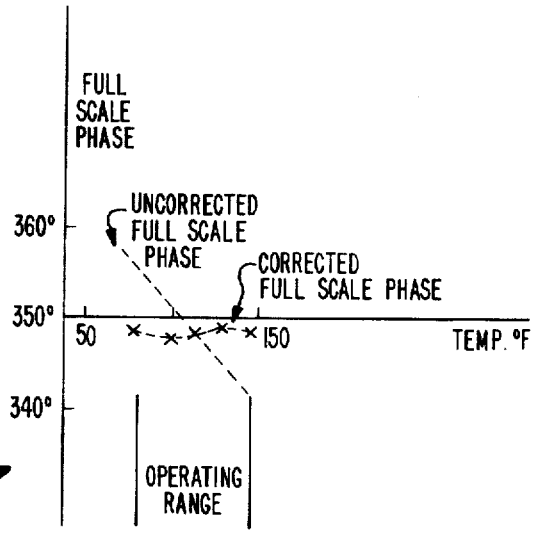

In the drawing:

FIG. 1 is a block diagram of a preferred temperature sensing and compensating flux drive gyromagnetic system, FIG. 2 is a timing diagram for the operation of the FIG. 1 system, FIG. 3 is a more detailed block diagram of the FIG. 1 system, FIG. 4 is a timing control signal diagram for the operation of the FIG. 3 system, FIG. 5 is a graph of the switched flux as a function of temperature, FIG. 6 is a plot of the correction voltage in the FIG. 3 system as a function of temperature, FIG. 7 is a graph of a phase shifter's phase variation with temperature in the absence of compensation and when the compensation system of FIG. 3 is used, and FIG. 8 is a detailed block diagram of a preferred system for performing the temperature compensation in the digital portion of the system.

In FIG. 1 a phase shifter system 9 including a control system 10 and a gyromagnetic waveguide phase shifter 11 is illustrated. Phase shifter 11 comprises a waveguide 12 which is loaded by a toroid 14 of gyromagnetic material through which drive wires 16 and 18 pass. The apparatus for coupling waves into and out of the phase shifter are not shown, since they are conventional, as is the phase shifter itself. The gyromagnetic material is preferably a temperature compensated material whose characteristics vary only slowly with temperature and which has a substantially square B vs. H loop in order to minimize the drive required to set a given remanence.

A first end of drive wire 16 is connected to the output of a first drive amplifier 19A and a first end of drive wire 18 is connected to the output of a second drive amplifier 19B. Drive amplifiers 19A and 19B each produce a substantially constant voltage output when on and are capable of providing high output currents—preferably at least 12 or 14 amperes. Each of the drive wires makes a single pass through the toroid (from opposite directions) and has its second end connected to one end of a 0.1 ohm resistor $R_S$ at a common node 17. The other end of resistor $R_S$ is grounded.

In the vicinity of these drive amplifiers the cathode of a diode $D_1$ is connected to wire 16 and the cathode of a diode $D_2$ is connected to wire 18. The anodes of these diodes are connected to a wire 71 which provides a sense voltage to a drive signal magnitude control system 70.

Magnitude is used throughout this specification in the sense of the degree to which the drive signal changes the remanent flux. Thus, different amplitude-(with signal)-versus-time signals can have the same magnitude in this sense, even though their shapes are very different. In the preferred embodiment, the magnitude is measured in volt-microseconds because this is a measure of the flux change induced. Thus, a 5-volt signal which lasts for 10 microseconds (μsecs) has the same magnitude as a 10-volt signal which lasts for 5 μsecs.

A driver control system 20 is connected in a driving relationship to the drivers 19A and 19B, in a sensing relationship to common node 17 and in a receiving relationship to an output line 77 from the drive signal magnitude control system 70.

A timing and control system 80 controls the sequence and timing of the operation of the system. The timing of some events is condition responsive rather than being strictly controlled by timing system 80.

The portions of control system 10 thus far recited constitute a complete phase shifter control system, but one which does not include any provision for compensating for temperature variations in the gyromagnetic material's characteristics.

When it is desired to set the phase shifter to a new phase shift value, the phase shifter is first reset by driving its gyromagnetic material 14 into saturation in a first direction. This is done under the control of timing and control system 80 which causes driver control 20 to turn on one of the drivers and then turn it off when the drive current reaches a magnitude $I_S$ associated with saturation of the gyromagnetic material. The drive current magnitude is sensed by sensing the voltage produced at node 17 by the drive current in resistor $R_S$. The voltage induced across $R_S$ by the saturation current $I_S$ can be called the saturation voltage $V_S$.

Subsequently, timer 80 initiates the establishment of the new phase shift by causing controller 20 to turn on the other driver. Controller 20 turns that driver off when the drive signal magnitude control 70 determines from the signal on line 71 that the desired drive signal magnitude has been reached and provides a driver turn-off signal on line 77. Whichever of the lines 16 or 18 is not being driven by the activated driver is connected to line 71 by the corresponding diode ($D_1$ or $D_2$, respectively). The non-driven line acts as the secondary winding of a "transformer" comprised of "windings" 16 and 18 and the gyromagnetic "core" 14. The voltage on line 71 when integrated is a measure of the flux change in the gyromagnetic material. The desired drive signal magnitude is one which will produce a remanence change in the gyromagnetic material which induces the desired phase shift. This remanence change and thus this drive signal magnitude is different for each different phase setting.

To provide temperature compensation, a sensing and compensating system 30 is connected to sense the present material characteristics of the gyromagnetic material and to generate a compensation signal which enables the drive signal magnitude control system 70 to compensate for any difference from the reference (nominal) characteristics on which system control is based. Compensation is obtained by turning off the phase setting driver at a drive signal magnitude which is different than under reference conditions and which yields the desired remanence change under the actual conditions and thus the desired phase shift.

Changes in its temperature are the primary cause of changes in the gyromagnetic material's characteristics. Sensing and compensation system 30 determines the temperature of the gyromagnetic material by integrating the flux change in the gyromagnetic material which takes place during a reversal in saturation remanence. The magnitude of the switched flux during a reversal in saturation is a function of the material's temperature because the size (and, to a lesser extent, the shape) of the B vs. H loop is a function of that temperature. The switched flux (in units of volt-$\mu$secs) during a reversal in saturation is plotted as a function of temperature in FIG. 5. This switched flux decreases substantially linearly with increasing temperature.

Sensing and compensating system 30 preferably comprises an integrator system 40, a sample and hold system 50 and a compensation system 60. The integrator 40 has a first input connected to the drive wire 18 where that wire enters the gyromagnetic toroid 14 and a second input connected to the common node 17. Alternatively, a separate sense wire may be threaded through the toroid and connected to the input of integrator 40. The output of the integrator 40 is connected to sample and hold system 50 whose output is connected to compensation system 60. The output of compensation system 60 is connected to the drive signal magnitude control 70.

At the beginning of a temperature measurement cycle (at $t_0$) the state of the integrator system 40 and the sample and hold system 50 are unimportant and drivers 19A and 19B are off (FIG. 2). At time $t_1$ timer 80 causes controller 20 to turn on driver 19B to provide a current to drive the gyromagnetic material 14 into saturation in a first direction. Driver control 20 shuts amplifier 19B off at time $t_2$ when the predetermined saturation voltage $V_S$ appears at node 17. Timing and control system 80 resets the sample and hold circuit at time $t_3$ and at time $t_4$ dumps integrator 40 and places it in the integrate condition. At time $t_5$ timer 80 causes controller 20 to turn driver 19A on. Driver control 20 turns driver 19A off when the voltage $V_S$ appears at node 17 at time $t_6$. The integrator is left on for a short time after time $t_6$ in order to include in the flux integration the flux decay as the gyromagnetic material returns to its saturated remanence flux level following the removal of the external field which was caused by the drive current. Timer 80 triggers sample and hold system 50 at time $t_7$ to cause it to sample and hold the integrator's output value. The integrator 40 may then be dumped as desired (illustrated at $t_8$).

Compensation system 60 uses this new "temperature" value in generating its compensation signal until the next temperature measurement is made.

A preferred implementation of the block diagram of FIG. 1 is illustrated in FIG. 3. The driver controller 20 comprises a flip-flop 22, a pair of NAND gates 24A and 24B, a pair of coupling capacitors 25A and 25B, a pair of NOR gates 26A and 26B and a voltage comparator 28. The normal state of flip-flop 22 in this circuit is with its output high. This output from flip-flop 22 is a first input to each of the NAND gates 24A and 24B. The second input of NAND gate 24A is a GATE A signal from timing and control system 80 and the second input to NAND gate 24B is a GATE B signal from timing and control system 80. The output from NAND gate 24A drives the first input of NOR gate 26A through the coupling capacitor 25A. The output of NAND gate 24B drives the first input of NOR gate 26B through capacitor 25B. The second input to each of the NOR gates (26A and 26B) is connected to line 77 which carries the driver turnoff signal from the drive signal magnitude control system 70.

Driver controller 20 turns on the corresponding driver in response to a GATE A or GATE B signal going high. Either of these signals alone will turn on the corresponding driver. The GATE A+B signal is used to assure resetting of flip-flop 22 when the GATE A+B signal returns to a low level at the end of the driver period. The driver which is thus turned on is turned off either by a driver turnoff signal (on line 77) from drive signal magnitude control system 70 (during the setting of a specific phase) or the appearance of a saturation voltage $V_S$ at node 17 (during the resetting of the phase shifter).

The integrator 40 comprises an input differential amplifier 42, an operational amplifier 44 connected as an integrator and an output scaling amplifier 46. As is conventional, the output from amplifier 42 is connected through a resistor $R_1$ to the negative input of operational amplifier 44. A capacitor $C_1$ is connected between this input and the output of amplifier 44 as a feedback element to establish the integration function. A switch $S_1$ is connected in parallel with the capacitor $C_1$ for controlling the dumping of the integrator. A control signal from timing and control system 80 controls the operation of the switch $S_1$ which is preferably a solid state switch rather than a mechanical switch.

The output of the integrating operational amplifier 44 is connected to the positive input of scaling amplifier 46. Scaling amplifier 46 has a voltage divider $R_3$, $R_4$ connected between its output and ground with the divider node connected to the amplifier's negative input. The values of resistors $R_3$ and $R_4$ are selected to provide a desired gain in this amplifier to provide proper scaling.

Sample and hold system 50 comprises an analog-to-digital converter (A/D) 52 which has its analog input connected to the output of amplifier 46 and its encode input connected to timing and control system 80. The output of A/D converter 52 is connected to a latch register 53 which provides indefinite storage. The transfer of data from A/D converter 52 to latch 53 is under the control of timing and control system 80 via a LATCH signal.

Compensation system 60 comprises digital-to-analog converter (D/A) 61, which has its input connected to the output of latch register 53 and its output connected to the positive input of an amplifier 62 whose output is connected through a resistor $R_7$ to the negative input of an offset amplifier 64. A voltage divider network $R_5$, $R_6$ is connected between amplifier 62's output and ground and has its divider node connected to the amplifier's negative input to control gain. A capacitor $C_5$ in parallel with the resistor $R_5$ enables rapid response to new temperature values. A parallel RC circuit ($R_8$, $C_8$) is connected between the output and the negative input of the offset amplifier 64 to establish a desired slope. Resistive voltage divider $R_9$, $R_{10}$ is connected between a reference voltage $V_{REF2}$ and ground and has its divider node connected to the positive input of offset amplifier 64 to establish the desired off-set (zero volts output at the reference temperature). A resistor $R_{11}$ is connected in series with the output of the offset amplifier.

The drive signal magnitude control system 70 comprises a phase setting selector 72 which provides a digital output which is connected to the digital input of a phase D/A converter 74. The reference input of phase D/A converter 74 (which provides the current which is apportioned by the D/A converter) is connected to a positive voltage reference $V_{REF3}$ via a resistor $R_{12}$ and to the output of offset amplifier 64 via the resistor $R_{11}$. The analog output of phase D/A converter 74 is connected to ground through a resistor $R_{13}$ to produce a voltage $V_P$ and is also connected to the positive input of an operational amplifier 76 which is operated as a comparator. The current at this analog output terminal of D/A converter 74 flows into the converter with the result that the voltage $V_P$ is less than or equal to zero.

The output from comparator 76 is connected to one input of an AND gate 78 whose output drives output line 77 is the drive signal magnitude control system 70. The negative input of the operational amplifier 76 is connected to the interior node of a series RC circuit comprised of a resistor $R_2$ and a capacitor $C_2$. The voltage at this node is denoted as $V_F$. The other end of the capacitor $C_2$ is grounded and the other end of the resistor $R_2$ is connected to line 71 and thus to the anodes of diodes $D_1$ and $D_2$. A switch $S_2$ is connected in parallel with capacitor $C_2$ to control the dumping of this capacitor. When the voltage $V_F$ becomes more negative than the voltage $V_P$, the output of comparator 70 switches from low to high to cause AND gate 78 to produce a high output unless AND gate 78 is inihibited by its disabling input being at a high level. A high output from gate 78 causes whichever NOR gate (26A or 26B) has a high output to change to a low output, thus turning off whichever driver 19A or 19B is on.

Timing and control system 80 comprises a clock 82, a cycle control AND gate 83, an address register 84, a read-only memory (ROM) 85, NAND gates 86 and 90, AND gates 88, 89, 92 and 94 and OR gate 87. Clock 82 provides the basic timing for the operation of the system and may preferably operate at a frequency of 1 MHz to produce a clock period of 1 microsecond. The output of the clock is connected to a first input of cycle control AND gate 83. The other input to cycle control AND gate 83 is a cycle control signal which becomes true when it is desired to go through a cycle of setting the phase of the phase shifter. When the cycle control signal is high, the clock pulses are passed by AND gate 83 to the increment input of address register 84. Thus, each clock pulse causes the address in register 84 to increase by 1. The address register 84 determines which address location of ROM 85 controls the output state of the ROM. The output of clock 82 is also connected directly to ROM 85 to control the clocking of the ROM. The Table shows the logic states stored in each register of a 32 register by 8-bit ROM which controls the operation and timing of the phase shifter control 10. When ROM 85 is stepped through its registers at a 1 MHz rate, the waveforms of FIG. 4 are generated at the output of the ROM. These waveforms include the high levels of the GATE A' and GATE B' signals which are shown dashed in FIG. 4.

| ADDRESS | LATCH' | ENCODE' | PHASE | GATE A & B | GATE A' | GATE B' | $\overline{\text{DUNK}}$ | DUNK |
|---|---|---|---|---|---|---|---|---|
| 0 | 0 | 0 | 0 | 0 | 0 | 0 | 1 | 0 |
| 1 | 0 | 0 | 0 | 0 | 0 | 0 | 0 | 1 |
| 2 | 0 | 0 | 1 | 1 | 0 | 1 | 0 | 1 |
| 3 | 0 | 0 | 0 | 1 | 0 | 1 | 0 | 1 |
| 4 | 0 | 0 | 0 | 1 | 0 | 1 | 0 | 1 |
| 5 | 0 | 0 | 0 | 1 | 0 | 1 | 0 | 1 |
| 6 | 0 | 0 | 0 | 1 | 0 | 1 | 0 | 1 |
| 7 | 0 | 0 | 0 | 0 | 0 | 0 | 0 | 1 |
| 8 | 0 | 0 | 0 | 0 | 0 | 0 | 0 | 1 |
| 9 | 0 | 0 | 0 | 0 | 0 | 0 | 0 | 1 |
| 10 | 0 | 0 | 0 | 0 | 0 | 0 | 1 | 0 |
| 11 | 0 | 0 | 0 | 1 | 1 | 0 | 1 | 0 |
| 12 | 0 | 0 | 0 | 1 | 1 | 0 | 1 | 0 |
| 13 | 0 | 0 | 0 | 1 | 1 | 0 | 1 | 0 |
| 14 | 0 | 0 | 0 | 1 | 1 | 0 | 1 | 0 |
| 15 | 0 | 0 | 0 | 0 | 0 | 0 | 1 | 0 |
| 16 | 0 | 0 | 0 | 0 | 0 | 0 | 1 | 0 |
| 17 | 0 | 0 | 0 | 0 | 0 | 0 | 1 | 0 |
| 18 | 0 | 0 | 0 | 0 | 0 | 0 | 1 | 0 |

-continued

| ADDRESS | LATCH' | ENCODE' | PHASE | GATE A & B | GATE A' | GATE B' | $\overline{DUNK}$ | DUNK |
|---|---|---|---|---|---|---|---|---|
| 19 | 0 | 0 | 0 | 0 | 0 | 0 | 0 | 1 |
| 20 | 0 | 0 | 1 | 1 | 1 | 0 | 0 | 1 |
| 21 | 0 | 0 | 0 | 1 | 1 | 0 | 0 | 1 |
| 22 | 0 | 0 | 0 | 1 | 1 | 0 | 0 | 1 |
| 23 | 0 | 0 | 0 | 1 | 1 | 0 | 0 | 1 |
| 24 | 0 | 0 | 0 | 1 | 1 | 0 | 0 | 1 |
| 25 | 0 | 1 | 0 | 0 | 0 | 0 | 0 | 1 |
| 26 | 1 | 0 | 0 | 0 | 0 | 0 | 1 | 0 |
| 27 | 0 | 0 | 0 | 1 | 0 | 1 | 1 | 0 |
| 28 | 0 | 0 | 0 | 1 | 0 | 1 | 1 | 0 |
| 29 | 0 | 0 | 0 | 1 | 0 | 1 | 1 | 0 |
| 30 | 0 | 0 | 0 | 1 | 0 | 1 | 1 | 0 |
| 31 | 0 | 0 | 0 | 0 | 0 | 0 | 1 | 0 |

The DUNK output of ROM 85 is connected to one input of OR gate 87. The output of OR gate 87 is connected to the disable input of AND gate 78 and to control the operation of switch $S_2$. A high output from OR gate 87 disables AND gate 78 and closes switch $S_2$. The second input of OR gate 87 is connected to a temperature measurement signal (TEMP) which is high during a temperature measurement cycle to cause OR gate 87 to provide a high output throughout a temperature measurement cycle. OR gate 87 maintains the disable input of gate 78 high throughout a temperature measurement cycle to assure that the output of gate 78 stays low throughout the cycle. In a non-temperature measurement cycle, the DUNK signal controls gate 78 to render it operative during the phase setting portions of the cycle, but inoperative during the reset portion of the cycle. The DUNK signal is also connected to one input of NAND gate 90 whose other input is connected to receive the TEMP signal. The output of NAND gate 90 is connected to control the operation of switch $S_1$ in order to open switch $S_1$ during the time that the DUNK signal is high during a temperature measurement cycle to allow integration of the switched flux. The $\overline{DUNK}$ and TEMP signals are combined in a NAND gate 86 to form an ENABLE signal which is high except when both the TEMP signal and the $\overline{DUNK}$ signal are high. This ENABLE signal and the GATE A' signal are combined by an AND gate 88 whose output is connected to the GATE A input of NAND gate 24A in the driver control system 20. The ENABLE signal and the Gate B' signal are combined by AND gate 89 whose output is connected to the GATE B input of NAND gate 24B of driver control system 20. The GATE A+B signal is connected directly to the GATE A+B input of flip-flop 22 of driver control 20.

The ENCODE' signal is combined with the TEMP signal by AND gate 92 to form the ENCODE signal. The output of AND gate 92 is connected to the ENCODE terminal of A/D converter 52. During a temperature measurement cycle AND gate 92 will pass the ENCODE' high signal level to cause the A/D converter to encode the output of the integrator 40 when the ENCODE signal goes to a high level.

The LATCH' signal is combined with the TEMP signal by AND gate 94 to produce a LATCH signal. The output of AND gate 94 is connected to the LATCH input of the latch register 53 which stores the output of the A/D converter 52. AND gate 94 passes the LATCH' high signal level during a temperature measurement cycle to cause latch register 53 to store the output of A/D converter 52 when the LATCH signal goes high. During phase shift setting cycles when temperature measurements are not taken AND gates 92 and 94 block the ENCODE' and LATCH' signals, thereby assuring that the latch 53 will continue to store the last previous temperature measurement value until the next temperature measurement cycle.

The various feedback networks around the amplifiers in the sensing and compensation system 30 are adjusted so that when the gyromagnetic material 14 of the phase shifter 11 is at the reference temperature the voltages at the non-inverting and inverting inputs to offset amplifier 64 are equal and no offset is generated. If the temperature of the gyromagnetic material 14 is above the reference temperature, then the switched flux is les than at the reference temperature and the offset amplifier provides a positive output whose value increases with increasing temperature of the gyromagnetic material. This has the effect of increasing the reference input current to the phase D/A converter 74 and thereby increases the output current from that D/A converter for a given digital input. This increases the absolute value of the voltage $V_p$ ($|V_p|$) at the non-inverting input to the comparator 76. This has the effect of lengthening the time it takes $|V_F|$ to reach the value $|V_p|$. This delays the turnoff of the driver and thus increases the magnitude of the drive signal.

Similarly, if the gyromagnetic material temperature is lower than the reference temperature, the switched flux is greater than at the reference temperature and the offset amplifier 64 provides a negative output which has the effect of reducing the current into the reference input of phase D/A converter 74 and thereby decreases the absolute magnitude of the voltage $V_p$. Thus, compensation system 60 causes the drive signal to have a greater magnitude in the high temperature situation than at the reference temperature and to have a lower magnitude in the low temperature situation than at the reference temperature for a given desired phase setting. This compensates for the temperature characteristics of the gyromagnetic material and provides an essentially flat phase vs. temperature characteristic for the phase shifter 11.

FIG. 6 is a graph of the output voltage from offset amplifier 64 as a function of temperature. This output voltage is 0 at the reference temperature (110° Fahrenheit), becomes negative as the temperature decreases and reaches a value of about −3.5 volts at a temperature of 70° F. and becomes more positive as the temperature increases reaching a value of about +3.5 volts at a temperature of +140° F.

FIG. 7 is a plot showing the effectiveness of this temperature compensation system. When the 5-bit phase shifter in this test is set to a maximum phase shift setting, the phase shifter has a maximum phase shift of about 348° at the reference temperature of 110° Fahrenheit. In the absence of compensation, this phase shift increases to about 356° at 70° Fahrenheit and decreases to about 341° at +140° Fahrenheit. When the phase compensation system of FIG. 3 is employed with 110° Fahrenheit as the reference temperature, the phase stays within about +1° of the 348° across the entire temperature range of 70° F. to 140° F. This corresponds to an even smaller RMS phase error and demonstrates the effectiveness of this technique.

Now referring to FIGS. 3 and 4, a temperature measurement cycle is executed in the following manner. At time 0 the $\overline{\text{DUNK}}$ signal from ROM 85 is at a high level (logic 1). All other outputs of the ROM are at a low level (logic 0). At 1 microsecond (μsec) from time 0 the DUNK signal goes high, the $\overline{\text{DUNK}}$ signal goes low and the externally supplied TEMP signal goes high. Alternatively, the TEMP signal can be set high before the beginning of the cycle. The high output of OR gate 87 due to TEMP being high inhibits gate 78 from passing the output of the driver turn-off comparator 76 and closes switch $S_2$ to maintain integrating capacitor $C_2$ in a discharged condition. Because the temperature signal is high, the high state of the DUNK signal causes the output of Gate 90 to go low to open switch $S_1$, thereby allowing integrator 40 to integrate (however, the results of this initial integration are not utilized).

At 2 μsec from time 0 the GATE B' signal goes high and is passed as the GATE B signal by AND gate 89 because the output of ENABLE gate 86 is high. The high GATE B signal turns on driver 19B to begin the phase shifter reset cycle, that is, to drive the phase shifter to saturation in a first direction. The GATE A+B signal also goes high at the 2 μsec point, as does the PHASE signal. The PHASE signal enables a setting of a new phase value into the phase D/A converter 74 which would control driver turn-off during the subsequent set cycle if this were not a temperature measurement cycle. At 3 μsec the PHASE signal goes low.

The next change in conditions occurs at about 5.5 microseconds from time 0 when the output signal from voltage comparator 28 which is normally high goes low when the voltage at node 17 reaches $V_S$. This triggers flip-flop 22 to change state and produce a low output. This low output latches flip-flop 22 in that state until the GATE A+B signal goes low (at 7 μsec from time 0). The low output from flip-flop 22 also causes the output of NAND Gate 24B to go high which causes the output of NOR gate 26B to go low which turns off driver 19B. This cuts off the current in wire 18 and the voltage at node 17 decreases to less than $V_S$ and the output of comparator 28 goes high again. This has no effect on the state of flip-flop 22 because the other input to the upper state of the flip-flop is low and that holds the output of that gate high.

At 7 μsec after time 0 the GATE B' and GATE A+B signals go low. GATE A+B going low causes flip-flop 22 to switch to a high output in readiness for the next drive cycle. At 10 μsec after time 0 the DUNK signal goes low and the $\overline{\text{DUNK}}$ signal goes high. The DUNK signal goes low would enable gate 78 and would open switch $S_2$ to allow integration of charge by capacitor $C_2$ if TEMP were low and does close switch $S_1$ to discharge the integrator capacitor $C_1$. The $\overline{\text{DUNK}}$ signal going high makes both inputs to NAND gate 86 high and thereby makes the ENABLE signal low.

At 11 μsec from time 0 the GATE A' and the GATE A+B signals both go high. Driver 19A does not turn on because the GATE A' signal is blocked by AND gate 88 whose ENABLE input signal is low and thus, the GATE A signal does not go high. For this reason, the high level of the GATE A' signal from 11 μsec to 15 μsec is shown dashed because that high level does not appear outside timing and control system 80 during a temperature measurement cycle.

During a non-temperature measurement cycle, the GATE A signal would have turned on driver 19A which would have stayed on until a desired magnetization as determined by comparator 76 had been obtained. At that time the signal on line 77 would have gone high to cause the output of NOR gate 26A to go low which would have turned off driver 19A. At 15 μsec after time 0 the GATE A' and GATE A+B signals go low.

At 19 μsec after time 0 the DUNK signal goes high and the $\overline{\text{DUNK}}$ signal goes low. The high DUNK signal again opens switch $S_1$ enabling the integration of the latch-to-latch switched flux which is about to be generated.

At 20 μsec after time 0, the GATE A', the GATE A+B and the PHASE signals all go high. The high PHASE signal again allows PHASE Setting Selector 72 to be reset. The GATE A' signal is now passed as the GATE A signal since the enable input of gate 88 is high. The high GATE A signal turns on driver 19A. At 21 μsec after time 0 the PHASE signal goes low.

The next change in the system conditions occurs at about 23.5 μsec after time 0, when driver 19A is turned off by flip-flop 22 switching states to a low output in response to comparator 28 producing a low output when the saturation voltage $V_S$ appears at node 17.

At 25 μsec after time 0 the GATE A' and the GATE A+B signals go low and the ENCODE signal goes high, causing A/D converter 52 to encode the output of integrator 40 since the TEMP signal is high.

At 26 μsec after time 0 the DUNK signal goes low, the $\overline{\text{DUNK}}$ signal goes high, the ENCODE signal goes low and the LATCH signal goes high. The LATCH signal goes high causes latch register 53 to store the outputs from A/D converter 52. The DUNK signal going low once again closes switch $S_1$ discharging integrator 40.

At 27 μsec after time 0 the LATCH signal goes low and the GATE B' and the GATE A+B signals go high. The GATE B' signal is blocked because gate 89's enable signal from gate 86 is low because this is a temperature measurement cycle. Consequently, driver 19B is not turned on. If this were not a temperature measurement cycle, the enable signal would have been high and driver 19B would have been turned on to set the phase shifter to the phase setting determined by the phase D/A converter 74.

At a subsequent time (in a non-temperature measurement cycle) determined by the established desired phase setting, driver 19B would be turned off by the voltage $V_F$ across capacitor $C_2$ becoming more negative than the voltage $V_p$ (at the positive input to comparator 76) which would cause comparator 76 to provide a high output. This high signal would be passed by gate 78 (which would be enabled by the DUNK signal being low). This high signal applied to the righthand transistors of the NOR gates 26B and 26A would turn these transistors on to pull the output of NOR gate 26B low to turn off driver 19B. For all phase settings this would occur prior to the time at which a saturation voltage $V_S$ would appear at node 17.

In a non-temperature measurement cycle, in the event that, because of some system failure, this turn-off signal were not generated prior to the saturation voltage $V_S$ being reached at node 17, comparator 28 would cause flip-flop 22 to change state, thereby shutting off the driver. At 31 μsec after time 0 the GATE B' and the GATE A+B signals go low with the result that in a non-temperature measurement cycle, even if both of the just described turn-off conditions failed to be obtained, the driver would be turned off by the removal of the GATE B signal from NAND Gate 24B.

In the event that for some reason the GATE B signal did not go low and neither of the turn-off signals described above had been effective in turning off the driver, the driver would be turned off by the decay of the voltage at the base of the lefthand transistor in the NOR Gate 26B as a result of the current fed from the V+ voltage source through the bias resistor to the base lead. It is to assure the eventual turnoff of the driver, independent of other turnoff conditions, that the capacitors 25A and 25B have been inserted in series between the NAND Gates 24A and 24B and the NOR Gates 26A and 26B, respectively.

No change in states occurs at 32 μseconds after time 0 since the ROM cycle has been completed by the addressing of its final register.

As soon as latch 53 switches to the new temperature value at 26 μsec after time 0 the D/A converter 61 changes its output value to correspond to the new temperature value then available at the output of latch 53. Compensator 60 immediately adjusts its output in accordance with this new analog input to the gain amplifier 62 and the reference input to the phase D/A converter 74 adjusts accordingly.

In the system of FIG. 3, the sample and hold system 50 is implemented as an A/D converter connected to a latch register in order that a long time period may be allowed between temperature measurements without a change in the stored value from the previous measurement. In a large functioning phase array system, temperature measurements may be spaced ten or more minutes apart without adversely affecting the temperature compensation of the system because of the high mass and only slowly varying external temperature. Such storage times are not readily available in high reliability analog sample and hold systems. Naturally, if only a very short duration of storage is needed, an analog sample and hold system may be substituted for the A/D converter 52, latch register 53 and the D/A converter 61.

An all-digital compensation system is illustrated in FIG. 8. This system is the same as that of FIG. 3 with the exception of the compensation system which is now numbered 160 and its connections to the drive signal magnitude control system 70.

The digital output from A/D converter 52 is stored by latch 53 and provided to a digital divider 164 as its divisor input. The flux change under reference conditions is applied to the dividend input of the digital divider 164 by storage register 162. The output of the digital divider is provided to a storage register 165 whose output connects to one input of a digital multiplier 166. The digital phase selection signal from phase setting selector 72 is provided as the second input to the digital multiplier 166. The output signal from the digital multiplier 166 is provided as a digital input to the phase D/A converter 74. In this configuration, the reference input to the phase D/A converter 74 remains fixed (rather than being adjusted as a compensation technique) and is determined solely by the voltage $V_{REF3}$ and the register $R_{12}$.

If desired, latch 53 may be omitted since only one division needs to be performed per temperature measurement cycle and the storage of its result in register 165 accomplishes the hold function.

What is claimed is:

1. A system for temperature compensation of a flux drive gyromagnetic system, said compensation system including:

means for switching the gyromagnetic structure of said gyromagnetic system from a saturated condition in one direction to a saturated condition in an opposing direction;

means for measuring the amount of flux change in said gyromagnetic structure during said switching;

means for determining from said measured flux change and a reference value the amount of compensation to be used; and means for modifying the drive signal which is used to set the gyromagnetic structure to a desired non-saturated condition in accordance with the amount of compensation determined by said means for determining.

2. The compensation system recited in claim 1 wherein:

said means for determining comprises means for comparing said measured flux change with a reference flux change which occurs under reference conditions.

3. The compensation system recited in claim 1 wherein:

said means for modifying increases the drive applied to said gyromagnetic material to more than the reference drive when the measured flux is less than the reference flux.

4. The compensation system recited in claim 1 wherein:

said gyromagnetic system is a gyromagnetic waveguide phase shifter.

5. A method of compensating for the variation with temperature of the magnetization characteristics of the gyromagnetic material of a gyromagnetic structure, said method comprising:

saturating said gyromagnetic material in a first direction;

driving said gyromagnetic material to a saturated condition in an opposing direction;

measuring the total flux change in said gyromagnetic material during said driving step;

comparing the flux change measured in said measuring step with the flux change under reference conditions; and modifying the drive signal used to set said gyromagnetic material to a desired non-saturated condition in an inverse fashion to the determined relationship between said measured flux and said reference flux.

6. A method of compensating for temperature induced variations in the response of a gyromagnetic material, said method comprising:

first driving said gyromagnetic material to a saturated condition in a first direction;

second driving said gyromagnetic material to a saturated condition in an opposing direction;

measuring the total flux change in said gyromagnetic material during said second driving step;

determining a drive sensitivity for said gyromagnetic material, said drive sensitivity being equal to the flux change under reference conditions divided by the measured flux change; and driving said gyromagnetic material with a drive signal equal to said drive sensitivity times the drive signal which would be utilized under reference conditions to obtain a desired change in the magnetization of said gyromagnetic material, thereby compensating for the temperature variation of the response of the gyromagnetic material to a given drive signal.

* * * * *